United States Patent [19]

Webb

[11] 4,147,175

[45] Apr. 3, 1979

[54] COIN HANDLING APPARATUS

[76] Inventor: Roy E. G. Webb, 33 Lampits, Hoddesdon, Hertfordshire, England

[21] Appl. No.: 841,567

[22] Filed: Oct. 12, 1977

[51] Int. Cl.[2] ..... G07D 3/00

[52] U.S. Cl. ..... 133/3 D; 133/8 R

[58] Field of Search ..... 133/3 D, 3 A, 3 C, 3 E, 133/8 R, 8 A, 8 C

[56] References Cited

U.S. PATENT DOCUMENTS

| | | | |
|---|---|---|---|
| 1,749,421 | 3/1930 | Donnellan | 133/3E |
| 1,813,296 | 7/1931 | Kidwell | 133/3 A |
| 3,045,864 | 7/1962 | Hurst, et al. | 133/8 R |
| 3,771,538 | 11/1973 | Reis | 133/3 D |
| 3,930,512 | 1/1976 | Woodland | 133/3 D |

*Primary Examiner*—Allen N. Knowles

*Attorney, Agent, or Firm*—Larson, Taylor and Hinds

[57] ABSTRACT

Coin sorting apparatus is described in which coins are taken from a hopper and positioned one by one into corresponding recesses in the outer periphery of a rotary disc. The disc rotates the coins in a circular arc. As it passes along its arcuate trajectory, each coin is sensed for its denomination so that a count can be made and recorded. The coins are fed over a series of openings of progressively increasing sizes so that each coin will fall into the first opening that can accommodate it. Each opening leads to a chute for directing coins into a corresponding collecting bag. Each bag thus collects only coins of one particular denomination and the number of coins therein are recorded.

6 Claims, 6 Drawing Figures

COIN HANDLING APPARATUS

BACKGROUND OF THE INVENTION

1. Field of the Invention

The present invention relates to coin handling apparatus, for sorting and counting coins for example.

2. Description of the Prior Art

Previously proposed coin handling apparatus involved pouring a batch of coins into a hopper, assembling the coins into a single line and rolling them along a linear but inclined path past a series of openings of progressively increasing size so that each coin fell under gravity in the first opening into which it could fit. Counting apparatus was provided for counting each coin as it fell into the opening. Such apparatus had a generally slow sorting rate since it relied on gravity for the coins to be fed along the linear path. Also the apparatus was susceptible to jamming. It is an object of the invention to provide an improved coin handling apparatus. It is a further object to provide apparatus having a high speed uninterrupted sorting and counting capability.

SUMMARY OF THE INVENTION

According to the invention there is provided coin handling apparatus, comprising a rotary conveyor member defining a plurality of coin-receiving recesses spaced apart around the rotary axis thereof, means supporting the conveyor and defining its rotary axis to be fixed and inclined to both the horizontal and vertical so that when the conveyor member is rotated about the axis the recesses follow a circular path passing through a lower station and an upper station, means mounted on the support means for feeding coins to the recesses at the lower station and means mounted on the support means for sensing the coin in each recess as it passes through the upper station to provide an output indicative of the size of the coin.

According to the invention there is provided coin handling apparatus, comprising a rotary disk defining a plurality of angularly spaced recesses in the periphery thereof, a circular platten having an axially extending outer rim, means supporting the platten in a plane inclined to both the horizontal and the vertical, and supporting the rotary disk on the circular platten so that the platten closes the lower axial flank of each recess and the rim closes the outer radial extremity of each recess, an arcuate plate mounted on the rim to close off the axially upper flanks of those recesses which at any instant are located at a lower portion of the platten, the circular platten defining a plurality of openings underlying the arcuate plate, the openings increasing progressively in magnitude in a circumferential sense whereby coins carried by said recesses as the disk rotates are deposited in openings corresponding to their size, a hopper for providing a reservoir of coins at a lower portion of the disk located above the arcuate plate, and a plurality of fingers mounted on the disk angularly spaced from one another and arranged, when in the reservoir of coins, to engage and drive a coin along the radially inner edge of the arcuate member out of the reservoir of coins, said engaged coin being allowed to move under gravity when it reaches the circumferential end of the arcuate member, into engagement with the rim and thereafter into a said recess when the next recess becomes aligned with the said coin.

BRIEF DESCRIPTION OF THE DRAWINGS

Coin handling apparatus embodying the invention will now be described by way of example, with reference to the accompanying diagrammatic drawings.

DESCRIPTION OF THE PREFERRED EMBODIMENTS

Figure 1:
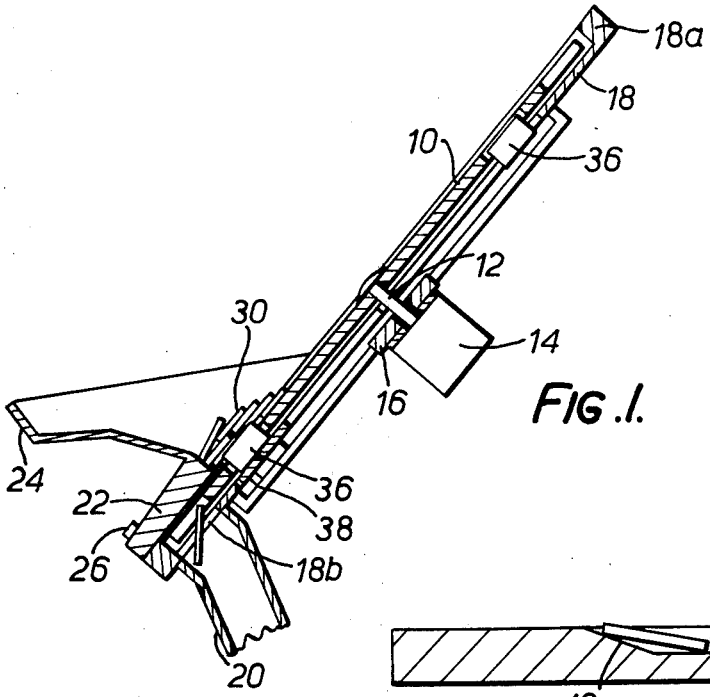
FIG. 1 is a section through the coin handling apparatus.

As shown in FIG. 1, a coin separating disk 10 (see also FIG. 2) is supported on a shaft 12 of an electric drive motor 14 so that the plane in which the disk lies is at an angle of 50° to the horizontal. The motor 14 is mounted on a frame 16 which also supports an annular platten 18. The annular platten 18 lying in a plane parallel to that of the disk 10 closely underlies the disk 10 to provide a minimal spacing between the outer circumferential portion of the disk 10 and the platten 18. The platten 18 has a rim **18*a* which traverses the plane of the disk 10 and lies radially spaced from the outer edge of the disk 10**.

Figure 5:
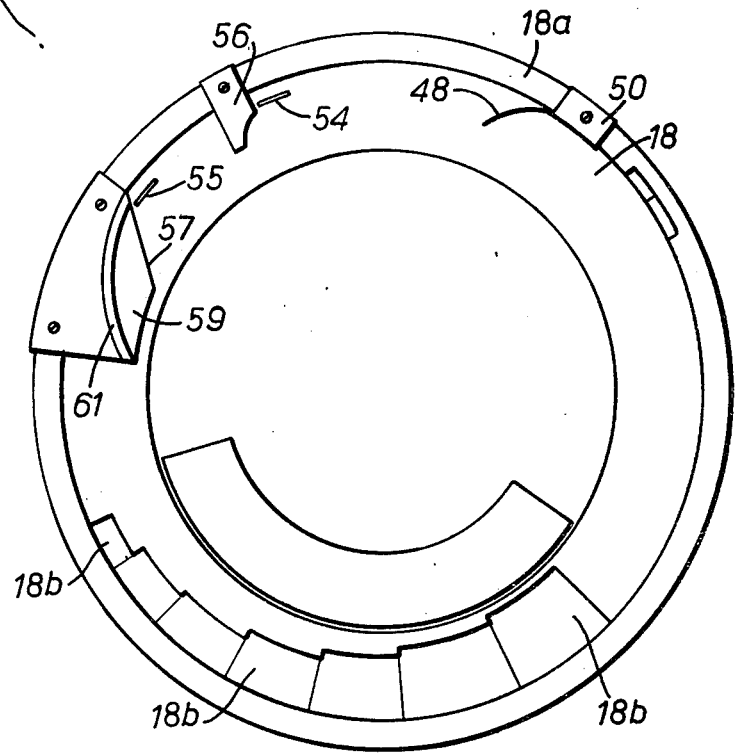
FIG. 5 is a view of the backing platten.

The platten 18 also has a plurality of circumferentially spaced openings **18*b* in a lower portion thereof (see FIG. 5) in which the openings are of progressively increasing sizes to accommodate different sized coins. Each opening 18*b* defines the entrance to a corresponding coin chute 20**.

A curved separating plate 22 (also shown in phantom lines in FIG. 2) is secured to the rim of the platten 18 by bolts 26. The curved plate 22 extends over the openings **18*b* and is spaced from the annular part of the platten 18 by a distance just slightly in excess of the thickness of the disk 10. The curved plate subtends an angle of about 180° with respect to the rotational axis of the motor 14. The plate 22 supports a coin hopper 24 which is arranged to direct a random collection of coins 30 towards the lower half portion of the disk in a region lying radially inwardly of the separating plate 22**.

Figure 2:
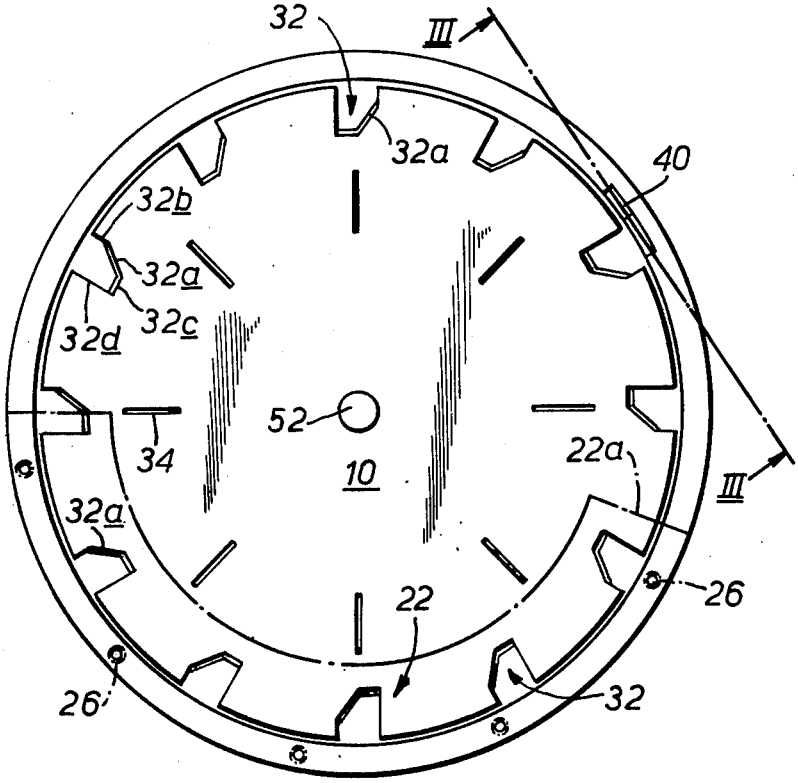
FIG. 2 is a view of the coin separating disk and the backing platten therefor with the coin hopper removed and the separating plate shown in phantom lines.

The disk 10, shown in more detail in FIG. 2, is formed with a plurality of shaped recesses 32 equi-spaced around the periphery of the disk. Each recess 32 is arranged to accommodate a coin lying on the annular platten 18 and, when the disk is rotated, to slide the confined coin over the surface of the platten 18 in a circumferential direction.

The width of each recess 32 in the circumferential direction increases progressively with distance from the axis of the motor. The floor **32*c* of each recess is planar and extends generally circumferentially of the disk. One of the two side walls of the disk extends radially while the remaining side wall has a radially inner portion 32*a* which is inclined at an acute angle to the radial direction, and a radially outer portion 32*b* which extends generally radially. The floor 32*c* and the radially inner portion 32*a* are chamfered to make an obtuse angle with the platten 18 in the space defined by the recess 32**.

The disk has a plurality of equiangularly spaced radially extending slots 34. A plurality of 'L'-shaped spring fingers 36 are located on the underside of the disk with one arm of each 'L'-shaped finger 36 extending circumferentially of the disk and the other arm extending into a respective slit 34. The outer end of the circumferentially extending arm is bolted to the disk by a bolt (not shown) and is curved in such a sense that the inner end of the same arm normally lies spaced from the disk 10 (see the upper finger 36 in FIG. 1). In this way, the fingers are normally prevented from projecting from the upper surface of the disk. However, a curved cam 38 secured to the frame 16 is arranged to engage each spring finger 36 as the spring finger travels through the lower part of its trajectory, when the disk is rotated, and so urges the finger to project above the upper surface of the disk (see the lower finger in FIG. 1).

In operation, a random collection of coins 30 is deposited in the hopper 24 and the coins fall under gravity against the lower part of the disk 10 which is not covered by the separator plate 22. The motor 14 is then energised and the disk 10 rotates. As the disk 10 rotates each spring finger 36 will pass through the lower part of its trajectory and in doing so will be engaged by the cam 36 and be caused to project from the upper surface of the disk. The projecting portion of the spring finger 36 will engage at least one coin which rests on the disk with its edge in contact with the radially inner edge of the separator 22 and will carry the coin circumferentially to rise out of the hopper. When the coin reaches the circumferential limit of the separator 22 it will roll downwardly along the radial edge **22*a* of the separator plate 22 and into contact with the rim 18*a* of the platten. At this point a recess 32 emerging from under the separator plate 22** will provide accommodation for the coin and will carry the coin circumferentially.

A first detector 62 (to be described in more detail hereinafter) senses whether the coin is correctly positioned in the recess or whether there is more than one coin, and a second detector 60 (also to be described in more detail hereinafter) senses the diameter of the coin to determine its denomination. If the coin is incorrectly positioned or there is more than one coin present, a first ejector mechanism located downstream of the first detector 62, is actuated to clear the recess.

A system of counters (not shown) responds to the second detector to record the numbers of coins of each denomination sensed and when a particular number of coins of a particular denomination is reached a signal is generated to cause a second ejector mechanism downstream of the second detector 60, to eject all further coins of that denomination but not of any other denomination. It will be appreciated that because the disk does not stop at this point but allows counting of the other denominations of coin to continue, a relatively high overall operating speed is achieved.

The coin in the recess continues its circumferential trajectory and in due course it will reach the other circumferential limit of the separator plate whereupon it passes under the plate 22. Eventually the coin will pass over the openings **18*b* and when the coin reaches an opening 18*b* of the same size as the coin, the coin will fall through that opening 18*b* (see FIG. 1) and down a corresponding chute 20**. A coin collecting bag (not shown) is fastened to the lower end of each chute and thus each bag will collect only those coins of the same denomination.

Figure 3:
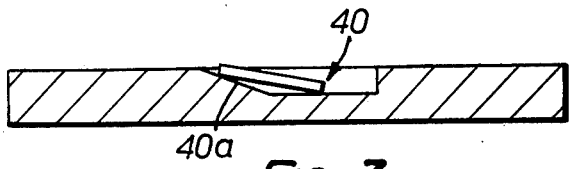
FIG. 3 is a section III—III of FIG. 2 to an enlarged scale.

In order to guard against two or more coins being present in a recess 32 at the same time, a slot 40 (see FIGS. 2 and 3) is cut in the inner circumferential wall of the rim **18*a* at a point located above the radial edge 22*a* of the separator plate. Thus when two coins are located in the same recess, then, as the recess moves upwardly, the radially outer coin will roll under gravity over the radially inner coin (which also under gravity will have rolled against the base 32*c* of the recess) against the rim 18*a*. As the recess passes the slot 40, the radially outer coin will roll into the slot and be carried along the length of the slot. The slot is provided with a cam surface 40*a* which will engage the radially outer coin as the coin reaches the upper limit of the slot. The cam will then cause the radially outer coin to be lifted out of the recess 32 and the coin will then fall back into the hopper 24**.

After each recess has passed the slot 40, a spring finger 48 (see FIG. 5) secured to the rim **18*a* by a fastening block 50 will enter the recess and engage any coin therein to urge the coin into contact with the wall 32*a*. If the coin is incorrectly seated in the recess the spring finger 48 is intended to urge the coin up the chamfer of the wall 32*a*** and the coin will be ejected to fall back into the hopper.

In order to prevent a build-up of ejected coins on the surface of the disk above its centre, a chamfered head 52 (which may be the head of the screw fastening the disk to the motor shaft 12) stands proud of the disk to dislodge any coins in the vicinity to fall to a lower level in the hopper.

The aforementioned first ejector mechanism for ejecting a coin from a recess comprises a solenoid (not shown) mounted on the underside of the platten and having a plunger 54 (see FIG. 5) which, when the solenoid is energised, will pass through an aperture in the platten to eject a coin located on the platten out of the recess. A guide 56 mounted on the rim **18*a*** ensures that the ejected coin is guided back into the hopper.

The second ejector mechanism also comprises a solenoid (not shown) mounted on the underside of the platten 18 and having a plunger 55 (see FIG. 5) which when the solenoid is energised, will pass through an aperture in the platten to eject a coin located on the platten out of the recess. A guide 57 mounted on the rim **18*a* ensures that the ejected coin is guided back into the hopper. The guide 57 includes a plate portion 59 lying parallel and close to the disk just downstream of the plunger and a curved guide wall portion 61 upstanding from the plate portion 61** and directed to guide the ejected coins toward a central portion of the hopper.

The detectors 60 and 62 are mounted circumferentially spaced from one another on a support 64 which in turn is secured to the rim **18*a***.

The detector 62 can take the form of a matrix or optical fibres each feeding a respective photo-detector, the output states of the photo-detectors forming codes representative of a particular type of coin when a coin of that type is carried by the recess into a reference position in front of the optical fibre matrix. The photo-detector outputs are fed to logic circuitry (not shown) which, when 'enabled' from a device (not shown) detecting the presence of a coin in the reference position, processes the photo-detector outputs to determine the type of coin present in the reference position.

Figure 4:
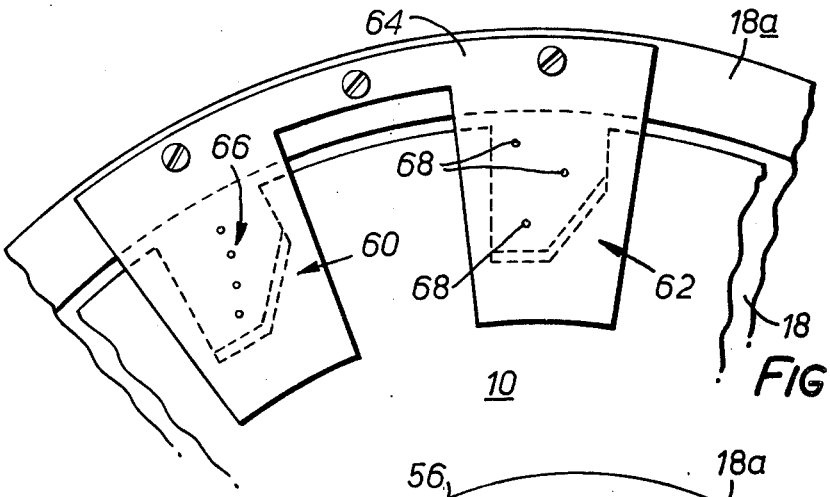
FIG. 4 is a fragmentary view of FIG. 2 to an enlarged scale illustrating coin sensors mounted on the backing platten.

The coin-size detector 62 comprises a row 66 (FIG. 4) of fibre ends extending generally radially of the disk 10 and past which coins positioned in the recesses 32 are successively moved.

The detector 62 takes a reading when the recess 32 seating the coin 30 is aligned directly opposite the optical fibre row 66 and, at the same time, the coin is seated in a recess 32 with its edge contacting divergent sides of the recess 32.

Figure 6:
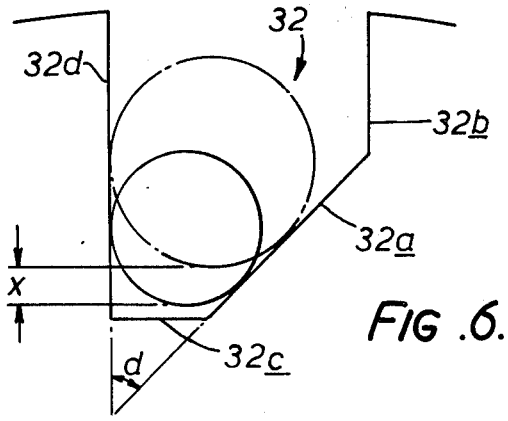
FIG. 6 is a fragmentary view to an enlarged scale of the disk of FIG. 2.

The advantage of using a divergent-sided recess to position a coin for sensing by the detector can be clearly seen by reference to FIG. 6 where two differently-sized coins are illustrated seated in a recess 32. Because the edge of the smaller coin engaging the sides is nearer the bottom 32*c* of the recess 32 than the edge of the larger coin, the difference in position between the radially outermost points of the coins is enhanced by a distance x. It will thus be appreciated that differences in coin size are effectively magnified which facilitates detection of coin size by the device 60 and enables smaller size differences to be detected without loss of accuracy.

The magnitude of the distance x for a given difference in coin size is a function of the angle of divergence of the recess sides 32*a* and 32*d*.

Correct positioning of a coin in a recess 32 is automatic in the present apparatus due to the non-horizontal inclination of the disk 10, resulting in the coin experiencing a radially inwards component of gravitational force near the top of its path of travel (that is, in the region of the detectors 60 and 62). Correct positioning of a recess 32 relative to the optical fibre row 66 is sensed by the detector 62 which is arranged so as to be uncovered only when the bottom 32*c* of the recess is radially aligned with the row 66; in this position of the recess 32 a coin seated in the recess is diametrically disposed across the row 66 with its radially outermost point arranged above the row 66. Means other than an optical fibre matrix can be used to detect the differing positions of differently sized coins in the recesses 32.

The shape of the recesses 32 can be selected to give predetermined steps in position between the radially outermost points of coins of a preselected group of differently sized coins independently of the actual differences in coin sizes.

The detector 62 is operative to prevent errors in detection at the detector 60 caused by the presence of more than one coin in a recess 32. By suitable positioning of photo-sensitive detectors (or the ends of optical fibres 68 feeding photo-detectors), the outline of two small-sized coins can be distinguished from that of a larger coin. To achieve this, the photo-detectors or fibre ends 68 are arranged over an area in a pattern enabling the detection of the lesser circumferential extend (around the disk) of a two-coin stack relative to that of a single coin for the same radial extent. A reference photo-detector (not shown) is also provided to detect the position of the recess 32. The outputs of the photo-detectors are fed to logic circuitry which determines whether one or more coins are present in each recess 32. If more than one coin is present, the coin-eject solenoid (not shown) is energized which pushes the excess coin or coins out of the recess 32 where they slide down the face of the disk 10 back into the hopper 24 as described earlier.

In a modified form of the apparatus, the disk 10 acting as a conveyor to present coins successively to the coin-size detection device 20 can be replaced by an annulus, the recesses being formed around the inner periphery of the annulus. The backing platten is made fast to the annulus 30 and both are rotated at high speed so that coins become positioned in the recesses 32 with their edges contacting divergent sides of the recesses by virtue of centrifugal forces acting on the coins. The annulus and the backing platten are then preferably mounted horizontally.

It will be appreciated that the effective amplification of differences in coin sizes produced by a divergently sided recess (such as the recesses 32) can be used in coin-recognition systems which do not utilize rotating conveyor members; for example, the recess may be formed in a manner which is stationary relative to a coin-size detection device, the coins being fed into the recess through the wide end thereof and being removed sideways out of the plane of the recess.

I claim:

1. Coin handling apparatus, comprising a rotary conveyor member defining a plurality of coin-receiving recesses spaced apart around the rotary axis thereof, means supporting the conveyor and defining its rotary axis to be fixed and inclined to both the horizontal and vertical so that when the conveyor member is rotated about the axis the recesses follow a circular path passing through a lower station and an upper station, means mounted on the support means for feeding coins to the recesses at the lower station, means mounted on the support means for sensing the coin in each recess as it passes through the upper station to provide an output indicative of the size of the coin, and a separator mounted on the support means at the lower station to define with the conveyor means a tunnel through which the recesses of the conveyor member pass on rotation of the conveyor member, the tunnel inhibiting the penetration of coins into the recesses from the coin feeding means while the recesses are in said tunnel.

2. Apparatus according to claim 1, wherein the tunnel has a ceiling, a floor and side walls with one said side wall being formed by said conveyor member, said floor defining a plurality of openings progressively increasing in size with distance along the tunnel whereby a coin carried by a said recess in the tunnel will fall into the first opening having the nearest size above that of the coin.

3. Apparatus according to claim 1, wherein each recess has a pair of diverging walls in which the separation increases progressively with distance from the said axis, whereby as the recess passes through the upper station the coin will under gravity engage both walls so that the radially outermost edge of the coin with respect to the said axis will be located a distance from the axis which is a function of the diameter of the said coin, and wherein the sensing means is arranged to sense the location of the said radially outermost edge of the coin.

4. Coin handling apparatus, comprising a rotary conveyor member defining a plurality of coin-receiving recesses spaced apart around the axis of rotation thereof, means supporting the conveyor and defining its axis of rotation to be fixed and inclined to both the horizontal and vertical so that when the conveyor member is rotated about the axis the recesses follow a circular path passing through a lower station and an upper station, means mounted on the support means for feeding coins to the recesses at the lower station, means mounted on the support means for sensing the coin in each recess as it passes through the upper station to provide an output indicative of the size of the coin, a plurality of movable fingers mounted on the conveyor member to be located angularly spaced around the conveyor member, means operative to cause each said finger to project above the upper surface of the conveyor member as the conveyor member passes through the lower station to circumferentially displace at least one coin fed to the lower station by the feeding means, and guide means for guiding a thus circumferentially displaced coin radially into a said recess.

5. Apparatus according to claim 4, including a member mounted on the support means and having a rim encircling the conveyor member to limit radially outward displacement of a coin in a said recess, said rim defining a slot in a radially inner wall thereof at a location intermediate the upper and lower stations, whereby if two coins inadvertently enter the same recess the radially outermost coin is forced under gravity to enter the slot, and cam means located in said slot to progressively displace the said radially outer coin out of the recess as the coin is driven along the slot in response to rotation of the converyor member.

6. Coin handling apparatus, comprising a rotary disk defining a plurality of angularly spaced recesses in the periphery thereof, a circular platten having an axially extending outer rim, means supporting the platten in a plane inclined to both the horizontal and the vertical, and supporting the rotary disk on the circular platten so that the platten closes the lower axial flank of each recess and the rim closes the outer radial extremity of each recess, an arcuate plate mounted on the rim to close off the axially upper flanks of those recesses which at any instant are located at a lower portion of the platten, the circular platten defining a plurality of openings underlying the arcuate plate, the openings increasing progressively in magnitude in a circumferential sense whereby coins carried by said recesses as the disk rotates are deposited in openings corresponding to their size, a hopper for providing a reservoir of coins at a lower portion of the disk located above the arcuate plate, and a plurality of fingers mounted on the disk angularly spaced from one another and arranged when in the reservoir of coins to engage and drive a coin along the radially inner edge of the arcuate member out of the reservoir of coins, said engaged coin being allowed to move under gravity when it reaches the circumferential end of the arcuate member, into engagement with the rim and thereafter into a said recess when the next recess becomes aligned with the said coin.

* * * * *